United States Patent [19]

Pitkanen

[11] 4,122,553

[45] Oct. 31, 1978

[54] CONVERTIBLE JACKET/VEST GARMENT

[76] Inventor: Alan R. Pitkanen, 3120 Ocean Dr., Manhattan Beach, Calif. 90266

[21] Appl. No.: 792,201

[22] Filed: Apr. 29, 1977

[51] Int. Cl.[2] ..... A41D 1/04

[52] U.S. Cl. ..... 2/102; 2/126

[58] Field of Search ..... 2/DIG. 7, 93, 102, 125, 2/126, 115

[56] References Cited

U.S. PATENT DOCUMENTS

| | | | |
|---|---|---|---|
| 2,153,838 | 4/1939 | Jay | 2/125 |
| 2,374,643 | 5/1945 | Boettcher | 2/114 |
| 3,137,007 | 6/1964 | Speer | 2/125 X |
| 4,006,495 | 2/1977 | Jones | 2/93 |

*Primary Examiner*—Doris L. Troutman

*Attorney, Agent, or Firm*—Keith D. Beecher

[57] ABSTRACT

A convertible garment is provided which can be worn either as a sleeved jacket, such as a parka, or as a sleeveless vest. The garment of the invention has fully attached sleeves, and it includes a linear zipper, or equivalent straight-line closure device, extending along the outside of each sleeve from the shoulder seam of the sleeve to a point just above the elbow. The zipper is long enough so that when opened, a hole is produced in each sleeve which corresponds in size with the arm holes in the jacket itself. When the garment is to be converted from a jacket to a vest, the zippers are pulled open and the sleeves are turned inside-out deploying them into the interior of the garment. The wearer then puts his arms through the holes in the sleeves, and the garment is worn as a vest.

3 Claims, 2 Drawing Figures

CONVERTIBLE JACKET/VEST GARMENT

BACKGROUND OF THE INVENTION

Garments in the form of jackets with semi-detachable sleeves are known to the art. U.S. Pat. No. 4,006,495, for example, discloses a jacket in which zippers extend partially around the shoulder seams of each of the sleeves. These zippers, when opened, permit the sleeves to be pulled into the interior of the jacket through the arm holes and tucked into a storage pouch which is provided in the back of the jacket. The wearer then can put his arms through the exposed arm holes and wear the jacket as a vest.

A problem with the prior art jacket described in the preceding paragraph, and as represented by the disclosure of the aforesaid patent, is that the fasteners are placed in areas of maximum stress on the garment. Specifically, the fasteners are placed at the sleeve and shoulder seams of the prior art garments, and the fasteners when opened create a weakness in the garments at a point of maximum wear and tear. Moreover, the fasteners must be affixed to the prior art garments and be operated along arcuate paths defined by the shoulder seams. This configuration of the fasteners creates difficulties in both the manufacture and operation of the prior art garments.

In contradistinction with the prior art, the convertible jacket of the present invention incorporates linear fasteners which are easy to affix to the garment and which are easy to operate. When the garment of the invention is to be converted from a jacket to a vest, the two fasteners are opened and the sleeves are turned inside-out, rather than being merely pulled into the interior of the garment, as is the case in the prior art. This action of turning the sleeves inside-out serves to deploy and distribute the sleeves within the jacket so as to obviate any need for storage pouches. Instead, the inside-out sleeves hang straight down from the shoulders inside the garment on each side of the wearer, thereby minimizing their contribution to added bulk of the garment or discomfort to the wearer.

Accordingly, the important objectives of the present invention are to provide an improved convertible garment which may be worn either as a jacket or a vest, and which exhibits substantial advantages in cost, reliability, durability and simplicity over the prior art convertible garments.

DETAILED DESCRIPTION OF THE ILLUSTRATED EMBODIMENT

Figure 1:
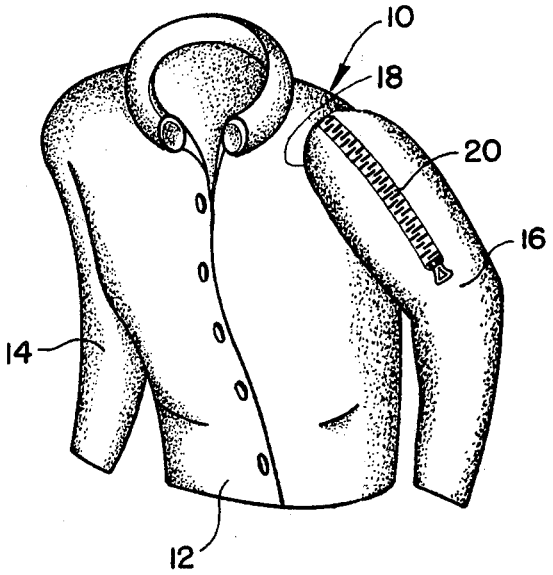
FIG. 1 is a perspective representation of a convertible garment representing one embodiment of the invention, and in the form of a sleeved jacket or parka.

The garment shown in the drawing is represented generally as 10. The garment includes a coat-like portion 12 which is intended to fit over the upper torso of the wearer. The garment also includes sleeves 14 and 16 which are attached to the portion 12 by appropriate shoulder seams, such as the seam 18, so as to constitute a jacket.

Each of the sleeves is provided with a linear slit which extends from the shoulder seam to a point just above the elbow, and each slit is closed by a linear fastener such as zipper 20. The length of each slit is such that when the zipper 20 is opened, each slit provides a hole corresponding in size to the arm holes of the garment.

When the garment is to be worn as a sleeved jacket, such as shown in FIG. 1, the sleeve 14 and 16 are worn outside the jacket, and the zipper 20, or equivalent fastener, is closed on each sleeve.

Figure 2:
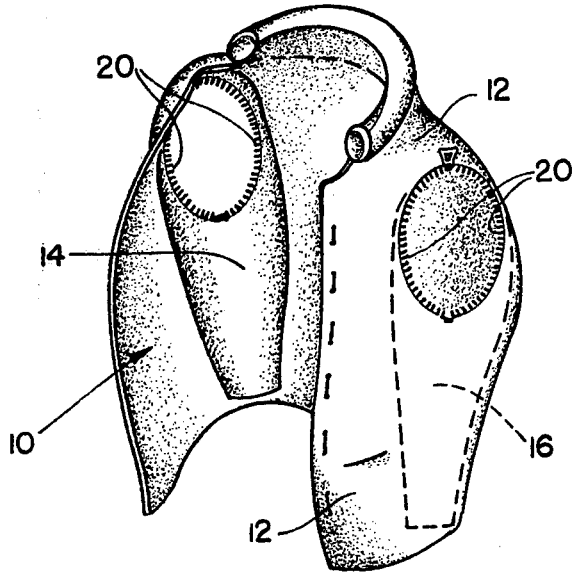
FIG. 2 is a perspective representation of the jacket of FIG. 1, with its sleeves turned inside-out and pulled into the interior of the garment, so that the garment may take the form of a sleeveless vest.

When the garment is to be worn as a vest, such as shown in FIG. 2, each zipper 20 is opened, and each sleeve is turned inside-out, deploying them into the interior of the portion 12, so that each sleeve hangs down in the interior of the portion 12 from the arm openings therein, as shown by the broken lines in FIG. 2. The wearer then may insert his arms through the arm holes and through the holes in the sleeves provided by the open zippers 20, so that the garment may be worn as a vest.

The invention provides, therefore, an improved garment which can be readily converted from a sleeved jacket into a sleeveless vest by opening two linear fasteners on the outside of the sleeves, and by turning the sleeves inside-out and pulling them into the interior of the garment. The use of linear fasteners enables shorter fasteners to be used, as compared with the prior art garments, and also provides for greater ease of installation and use of the fasteners. The garment of the invention does not require storage pouches for the sleeves, which the sleeves are pulled into the interior of the garment. Instead, as described above, the sleeves merely hang straight down from the arm holes so as to be distributed in a manner such that they do not add in any substantial way to the bulkiness of the garment.

Moreover, the sleeves of the garment of the present invention are always fully attached to the garment itself, and never become the equivalent of vulnerable, tethered fabric flaps, as in the case with the prior art garments.

It will be appreciated that although a particular embodiment of the invention has been shown and described, modifications may be made. It is intended in the following claims to cover all the modifications which come within the true spirit and scope of the invention.

What is claimed is:

1. A garment having a first portion for covering the upper torso of a wearer and having arm holes in the sides of the first portion for receiving the arms of the wearer; a pair of sleeves attached to said first portion of the garment by respective shoulder seams which extend around said arm holes, each of said sleeves extending from the corresponding shoulder seam to the wrist of the wearer and each of said sleeves having a longitudinal linear slit therein extending down the outside of such sleeve from a point adjacent to the corresponding shoulder seam a predetermined distance along such sleeve to a point adjacent to the elbow of such sleeve; said slit having a selected length such that it may be opened to an opening corresponding in size to the corresponding arm hole in the side of said first portion of the garment; and a linear closure means attached to each of the sleeves for selectively opening and closing the corresponding slit.

2. The garment defined in claim 1, in which said closure means is a zipper.

3. The garment defined in claim 1, in which said sleeves are turned inside out and inserted into said arm holes and hang down the interior of said first portion of the garment so that the garment may be worn as a vest.

* * * * *